US010280793B2

(12) United States Patent
Vu

(10) Patent No.: US 10,280,793 B2
(45) Date of Patent: May 7, 2019

(54) INSERT AND STANDOFF DESIGN FOR A GAS TURBINE ENGINE VANE

(71) Applicant: UNITED TECHNOLOGIES CORPORATION, Farmington, CT (US)

(72) Inventor: Ky H. Vu, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 489 days.

(21) Appl. No.: 15/021,998

(22) PCT Filed: Aug. 28, 2014

(86) PCT No.: PCT/US2014/053041

§ 371 (c)(1),
(2) Date: Mar. 15, 2016

(87) PCT Pub. No.: WO2015/057309

PCT Pub. Date: Apr. 23, 2015

(65) Prior Publication Data

US 2016/0222823 A1 Aug. 4, 2016

Related U.S. Application Data

(60) Provisional application No. 61/879,282, filed on Sep. 18, 2013.

(51) Int. Cl.
*F01D 25/12* (2006.01)
*F01D 9/06* (2006.01)
(Continued)

(52) U.S. Cl.
CPC ..... *F01D 25/12* (2013.01); *F01D 9/041* (2013.01); *F01D 9/065* (2013.01); *F01D 5/189* (2013.01);
(Continued)

(58) Field of Classification Search
CPC ..... F01D 25/12; F01D 9/041; F01D 9/065; F01D 5/189; F05D 2220/32; F05D 2230/60; F05D 2240/81; F05D 2260/201
See application file for complete search history.

(56) References Cited

U.S. PATENT DOCUMENTS 3,628,880 A 12/1971 Smuland
4,105,364 A 8/1978 Dodd
(Continued)

FOREIGN PATENT DOCUMENTS

WO 2013117258 A1 8/2013

OTHER PUBLICATIONS

International Preliminary Report on Patentability for PCT Application No. PCT/US2014/053041, dated Mar. 31, 2016.
(Continued)

*Primary Examiner* — Aaron R Eastman
(74) *Attorney, Agent, or Firm* — Carlson, Gaskey & Olds, P.C.

(57) ABSTRACT

A component for a gas turbine engine according to an exemplary aspect of the present disclosure includes, among other things, a platform, an airfoil that extends from the platform, and an insert positioned such that a first portion of the insert extends relative to a surface of the platform and a second portion extends inside the airfoil. A standoff supports the insert above the surface.

20 Claims, 4 Drawing Sheets

(51) Int. Cl.
*F01D 9/04* (2006.01)
*F01D 5/18* (2006.01)

(52) U.S. Cl.
CPC ..... *F05D 2220/32* (2013.01); *F05D 2230/60* (2013.01); *F05D 2240/81* (2013.01); *F05D 2260/201* (2013.01)

(56) References Cited

U.S. PATENT DOCUMENTS 5,193,975 A 3/1993 Bird et al.
5,630,700 A * 5/1997 Olsen ..... F01D 5/189 415/134
7,497,655 B1 * 3/2009 Liang ..... F01D 5/189 415/1
7,857,588 B2 12/2010 Propheter-Hinckley et al.
8,162,617 B1 4/2012 Davies et al.
8,240,987 B2 8/2012 Spangler et al.
8,608,430 B1 * 12/2013 Liang ..... F01D 5/187 415/115
2006/0005546 A1 * 1/2006 Orlando ..... F01D 9/065 60/782
2008/0170944 A1 * 7/2008 Propheter-Hinckley ..... F01D 5/188 416/229 R
2010/0054915 A1 * 3/2010 Devore ..... F01D 5/189 415/116
2010/0129196 A1 5/2010 Johnston et al.
2010/0221123 A1 * 9/2010 Pal ..... F01D 5/189 416/97 R
2010/0232946 A1 9/2010 Propheter-Hinckley et al.
2011/0107769 A1 * 5/2011 Stevenson ..... F01D 9/04 60/772
2011/0123351 A1 * 5/2011 Hada ..... F01D 5/189 416/97 R
2013/0025123 A1 1/2013 Vetere et al.
2015/0322800 A1 * 11/2015 Crosatti ..... B22F 5/04 416/95

OTHER PUBLICATIONS

Extended European Search Report for Application No. EP 14 85 4393 dated Aug. 30, 2016.
International Search Report and Written Opinion of the International Searching Authority for International application No. PCT/US2014/053041 dated May 20, 2015.

* cited by examiner

INSERT AND STANDOFF DESIGN FOR A GAS TURBINE ENGINE VANE

STATEMENT REGARDING FEDERALLY SPONSORED RESEARCH OR DEVELOPMENT

This invention was made with government support under Contract No. FA8650-09-D-2923-0021, awarded by the United States Air Force. The Government therefore has certain rights in this invention.

BACKGROUND

This disclosure relates to a gas turbine engine, and more particularly to a gas turbine engine component, such as a vane, having an insert spaced from a surface of the component by one or more standoffs.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other loads.

Both the compressor and turbine sections of a gas turbine engine may include alternating rows of rotating blades and stationary vanes that extend into the core flow path of the engine. For example, in the turbine section, turbine blades rotate to extract energy from the hot combustion gases. The turbine vanes direct the combustion gases at a preferred angle of entry into the downstream row of blades. Blades and vanes are examples of components that may need cooled by a dedicated source of cooling air in order to withstand the relatively high temperatures they are exposed to.

SUMMARY

A component for a gas turbine engine according to an exemplary aspect of the present disclosure includes, among other things, a platform, an airfoil that extends from the platform, and an insert positioned such that a first portion of the insert extends relative to a surface of the platform and a second portion extends inside the airfoil. A standoff supports the insert above the surface.

In a further non-limiting embodiment of the foregoing component, the component is a vane.

In a further non-limiting embodiment of either of the foregoing components, the first portion of the insert is a baffle lip and the second portion is a baffle body that extends from the baffle lip.

In a further non-limiting embodiment of any of the foregoing components, an axial gap extends between an edge of the insert and a rail of the platform.

In a further non-limiting embodiment of any of the foregoing components, a radial gap extends between the surface of the platform and the first portion of the insert.

In a further non-limiting embodiment of any of the foregoing components, the standoff extends between a non-gas path surface of the platform and the first portion of the insert.

In a further non-limiting embodiment of any of the foregoing components, a plurality of standoffs are cast and/or machined as part of the platform.

In a further non-limiting embodiment of any of the foregoing components, a cover plate is positioned radially outboard of the insert.

In a further non-limiting embodiment of any of the foregoing components, the insert is welded or brazed to a vane rib that extends between a first cooling cavity and a second cooling cavity that extend through the airfoil.

In a further non-limiting embodiment of any of the foregoing components, the second portion of the insert extends into at least one of the first cooling cavity and the second cooling cavity.

A gas turbine engine according to an exemplary aspect of the present disclosure includes, among other things, a component that includes a platform, an airfoil that extends from the platform, an insert having a baffle lip that extends above a surface of the platform, and a baffle body that extends inside a cooling cavity of the airfoil. A standoff extends to the baffle lip to support the insert.

In a further non-limiting embodiment of the foregoing gas turbine engine, the component is a vane.

In a further non-limiting embodiment of either of the foregoing gas turbine engines, the surface is a non-gas path surface of the platform.

In a further non-limiting embodiment of any of the foregoing gas turbine engines, a vertical gap is located between the surface and the baffle lip.

In a further non-limiting embodiment of any of the foregoing gas turbine engines, a plurality of standoffs elevate the baffle lip above the surface.

In a further non-limiting embodiment of any of the foregoing gas turbine engines, a cover plate is positioned radially outboard of the surface to create a platform cooling channel.

A method of cooling a component of a gas turbine engine according to another exemplary aspect of the present disclosure includes, among other things, positioning an insert relative to a platform and an airfoil of a component, spacing the insert above a surface of the platform, feeding a cooling fluid between the surface and the insert, cooling the surface with the cooling fluid and cooling the airfoil with the cooling fluid.

In a further non-limiting embodiment of the foregoing method, the step of positioning includes providing a cover plate radially outboard of the insert.

In a further non-limiting embodiment of either of the foregoing methods, the surface is a non-gas path surface of the platform.

In a further non-limiting embodiment of any of the foregoing methods, the method includes feeding the cooling fluid inside the insert.

The embodiments, examples and alternatives of the preceding paragraphs, the claims, or the following descriptions and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to a gas turbine engine vane that includes an insert spaced from a platform of the vane and supported by one or more standoffs. The standoffs protrude from a non-gas path surface of the platform and establish a radial gap between the insert and the platform. A cooling fluid can be communicated through the radial gap to convectively cool the platform prior to cooling additional portions of the vane, such as the airfoil. These and other features are described in detail herein.

Figure 1:
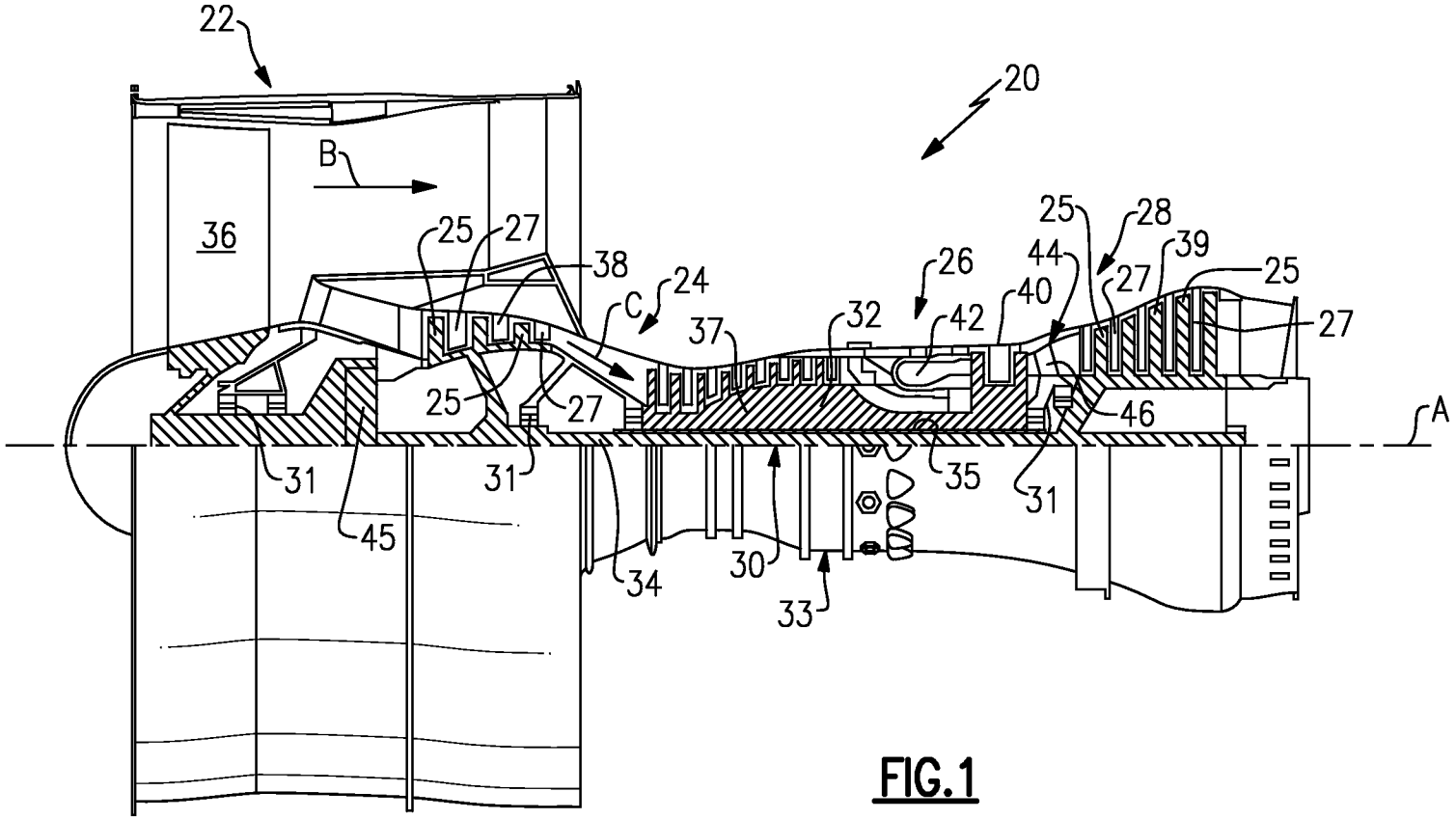
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in this non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Various components of the gas turbine engine 20, including but not limited to the airfoil and platform sections of the blades 25 and vanes 27 of the compressor section 24 and the turbine section 28, may be subjected to repetitive thermal cycling under widely ranging temperatures and pressures. The hardware of the turbine section 20 is particularly subjected to relatively extreme operating conditions. Therefore, some components may require dedicated internal cooling circuits to cool the parts during engine operation. This disclosure relates to gas turbine engine components having insert and standoff designs that enable convective heat transfer between a cooling fluid and a platform, as is further discussed below.

Figure 2:
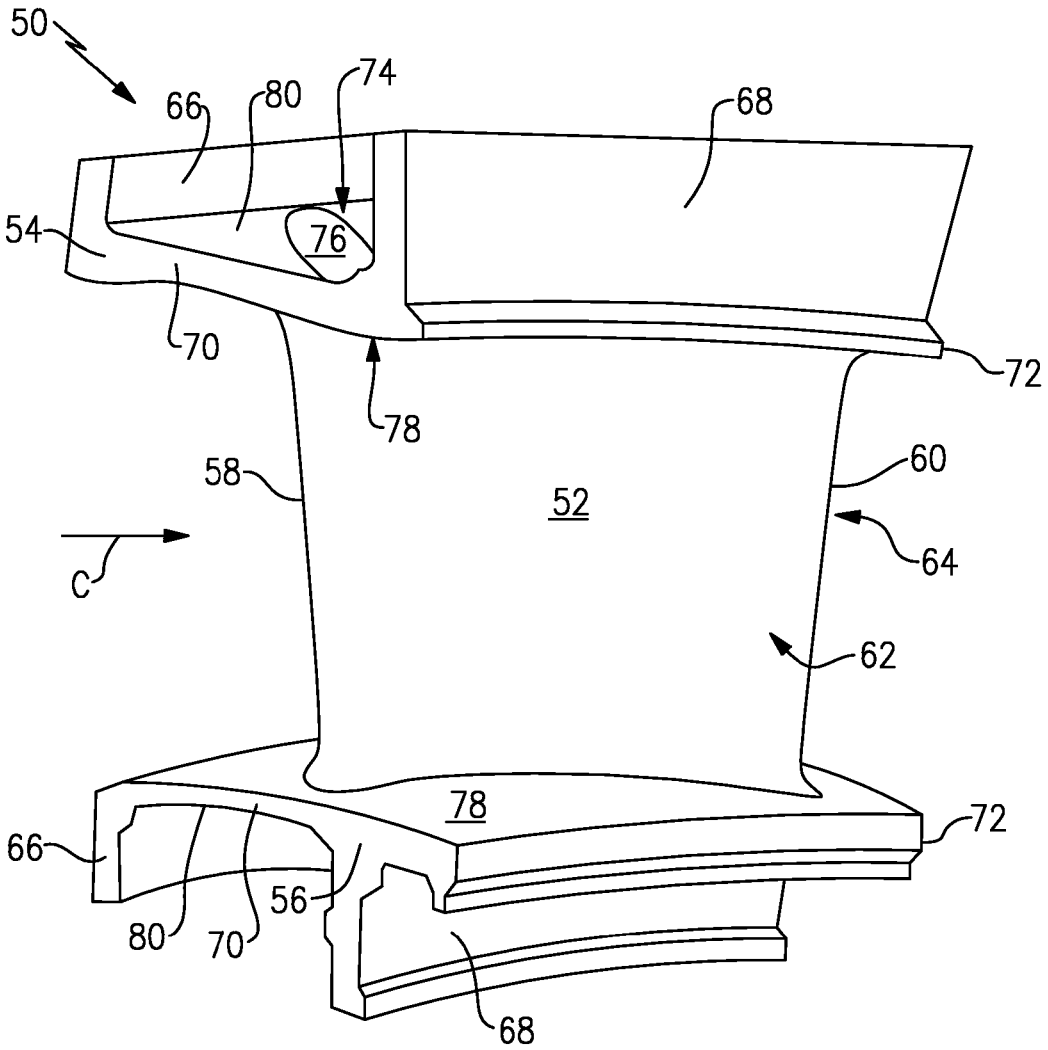
FIG. 2 illustrates a vane that can be incorporated into a gas turbine engine.

FIG. 2 illustrates a vane 50 that can be incorporated into a gas turbine engine, such as the compressor section 24 or the turbine section 28 of the gas turbine engine 20 of FIG.

1. Although illustrated as a vane, other gas turbine engine components could embody the various features and advantages of this disclosure.

The vane 50 may be part of a vane assembly (not shown) that includes a plurality of vanes circumferentially disposed about the engine centerline longitudinal axis A and configured to direct the combustion gases of the core flow path C at a preferred angle of entry into a downstream row of blades.

The vane 50 includes an airfoil 52 that extends between an outer platform 54 and an inner platform 56. The airfoil 52 axially extends between a leading edge 58 and a trailing edge 60 and circumferentially extends between a pressure side 62 and a suction side 64. The outer platform 54 and inner platform 56 may axially extend between a leading edge rail 66 and a trailing edge rail 68 and circumferentially extend between a first mate face 70 and a second mate face 72. The vane 50 may be connected relative to other vane segments at the first and second mate faces 70, 72 to construct a full ring vane assembly.

Each of the outer platform 54 and the inner platform 56 includes a gas path surface 78 and a non-gas path surface 80. The gas path surface 78 is exposed to the hot combustion gases of the core flow path C, whereas the non-gas path surface 80 is remote from the core flow path C.

The vane 50 may include a cooling scheme 74 that includes one or more cooling cavities 76 disposed through portions of the outer platform 54, the inner platform 56 and/or the airfoil 52. Exemplary cooling schemes are described in greater detail below with respect to FIGS. 3, 4 and 5.

Figure 3:
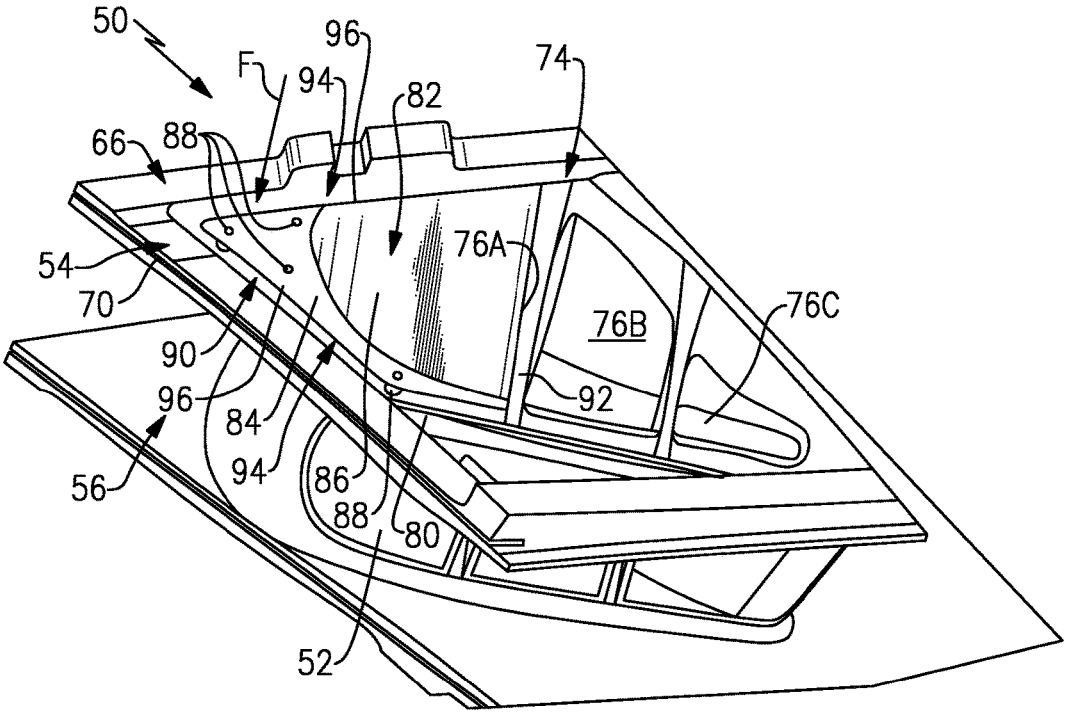
FIG. 3 illustrates an exemplary cooling scheme of a gas turbine engine vane.

FIG. 3 illustrates a first embodiment of a cooling scheme 74 that can be incorporated into a vane 50. The cooling scheme 74 may include one or more cooling cavities 76 for directing a cooling fluid F relative to the outer platforms 54 (or inner platform 56) and subsequently into other parts of the vane 50. In one embodiment, three cooling cavities 76A, 76B and 76C are provided. Of course, fewer or additional cooling cavities can be formed inside of the vane 50. The cooling cavities 76 may be formed in a casting process using ceramic cores and/or refractory metal cores.

The cooling cavities 76A, 76B and 76C open through the outer platform 54 and the inner platform 56. In this way, the cooling fluid F can be used to convectively cool both the airfoil 52 and the outer and inner platforms 54, 56.

In one embodiment, an insert 82 is received relative to at least one of the cooling cavities 76 (here, the cooling cavity 76A). The insert 82 may be a shaped piece of sheet metal that includes a baffle lip 84 positioned relative to the non-gas path surface 80 of the outer platform 54 and a baffle body 86 that extends into the cooling cavity 76A, or at least partially inside the airfoil 52. In one embodiment, the baffle lip 82 extends transversely from the baffle body 86. Although not shown, a similar configuration could be disposed at the inner platform 56. It should also be appreciated that the insert 82 may embody any size or shape within the scope of this disclosure.

One or more standoffs 88 may extend between the non-gas path surface 80 and the insert 82. In one embodiment, a plurality of standoffs 88 are cast and/or machined as part of the vane 50 and are configured to support the insert 82 above the outer platform 54 (and/or the inner platform 56). For example, the standoffs 88 may be arranged at multiple locations of the outer platform 54 and inner platform 56 to space the insert 82 away from the non-gas path surfaces 80. In other words, the standoffs 88 elevate the insert 82 above the non-gas path surface 80 to define a radial gap 90 (see also FIG. 4) between the outer platform 54 (and/or the inner platform 56) and the baffle lip 84 of the insert 82.

The insert 82 may be welded or brazed to a vane rib 92 that extends between the first cooling cavity 76A and the second cooling cavity 76B. The baffle lip 84 of the insert 82 may also be welded or otherwise attached to each standoff 88 to secure the insert 82 to the vane 50. In one embodiment, the insert 82 is secured to the vane 50 such that an axial gap 94 extends between edges 96 of the baffle lip 84 of the insert 82 and both the leading edge rail 66 and the mate face 70 of the outer platform 54. The actual dimensions of the radial gap 90 and the axial gap 94 are not intended to limit this disclosure. In fact, these dimensions are design specific and could vary depending on the cooling requirements of a particular gas turbine engine component.

Figure 4:
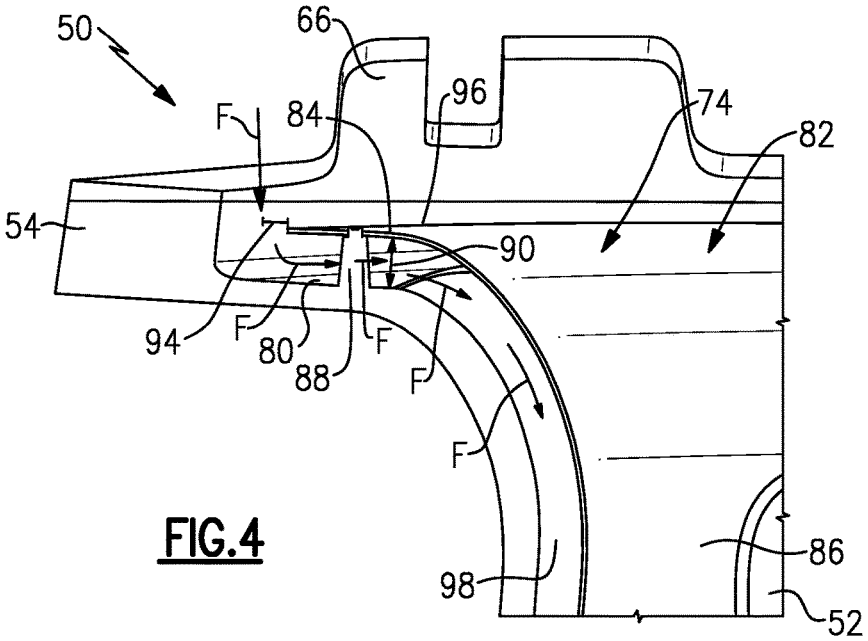
FIG. 4 illustrates a view taken through section A-A of the vane of FIG. 3.

Referring to FIG. 4 (with continued reference to FIG. 3), in one non-limiting embodiment, a cooling fluid F may be communicated into the axial gap 94 between the leading edge rail 66 and the edge 96 of the baffle lip 84. In other words, the axial gap 94 acts as an inlet to the cooling scheme 74. The cooling fluid F may travel between the non-gas path surface 80 and the insert 82 to convectively cool the outer platform 54. After cooling the outer platform 54, the cooling fluid F may then be communicated into the airfoil 52. For example, the cooling fluid F may travel between an inner wall 98 of the cooling cavity 76A and the baffle body 86 of the insert 82 in order to convectively cool the airfoil 52. Although not shown, the cooling fluid F could optionally next be communicated to cool the non-gas path surface 80 of the inner platform 56 in a similar manner.

Figure 5:
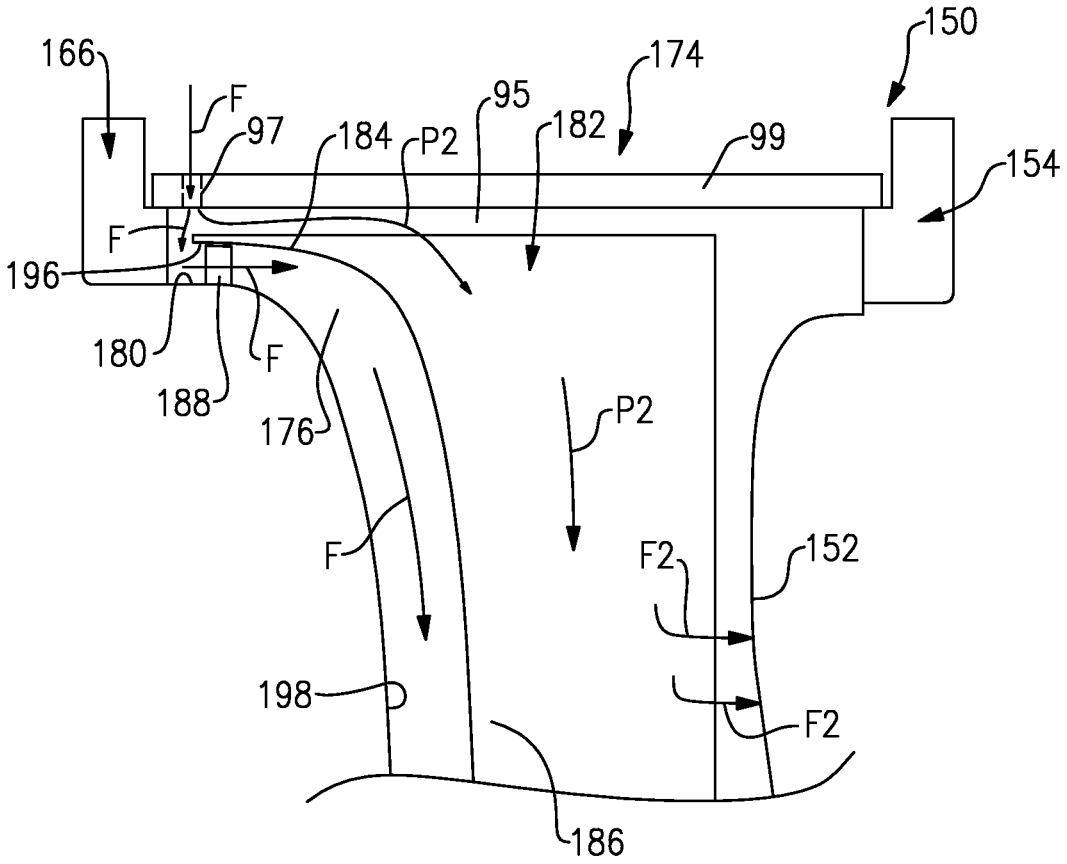
FIG. 5 illustrates another exemplary cooling scheme of a gas turbine engine vane.

FIG. 5 illustrates another cooling scheme 174 that can be incorporated into a vane 150. In this disclosure, like reference numerals designate like elements where appropriate and reference numerals with the addition of 100 or multiples thereof designate modified elements that are understood to incorporate the same features and benefits of the corresponding original elements.

In this embodiment, the vane 150 incorporates a cover plate 99 into the cooling scheme 174. For example, the cover plate 99 may be positioned radially outboard of an insert 182 and the non-gas path surface 180 of a platform 154 of the vane 150 to create a platform cooling channel 95. The platform 154 could be an inner or outer platform. The insert 182 is elevated above non-gas path surface 180 by one or more standoffs 188.

The cover plate 99 includes an inlet 97, such as an opening, for directing a cooling fluid F into the platform cooling channel 95. The cooling fluid F may travel between a rail 166 and an edge 196 of a baffle lip 184 of the insert 82, and then between the baffle lip 184 and a non-gas path surface 180, to convectively cool the platform 154. Subsequently, the cooling fluid F may be communicated into a cooling cavity 176 between an inner wall 198 of an airfoil 152 and a baffle body 186 of the insert 182 to convectively cool the airfoil 152. Optionally, a portion P2 of the cooling fluid F could also be communicated through the cover plate 99 and directly into the insert 182, such as for impingement cooling portions of the airfoil 152, such as illustrated by impingement cooling fluid F2.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component for a gas turbine engine, comprising:

a platform;

an airfoil that extends in a radial direction from said platform and that extends in an axial direction between a leading edge and a trailing edge;

an insert positioned such that a first portion of said insert extends relative to a surface of said platform and a second portion extends from said first portion in said radial direction such that said second portion is inside said airfoil; and a standoff that supports said insert away from said surface to define a radial gap that extends in said radial direction between said surface of said platform and said first portion of said insert to establish an internal cooling cavity; and wherein said internal cooling cavity extends along said surface of said platform, across said standoff and between said second portion and an inner wall of said airfoil.

2. The component as recited in claim 1, wherein the component is a vane.

3. The component as recited in claim 1, wherein said first portion of said insert is a baffle lip and said second portion is a baffle body that extends from said baffle lip.

4. The component as recited in claim 1, comprising an axial gap that extends in said axial direction between an edge of said insert and a rail of said platform.

5. The component as recited in claim 4, wherein:

said first portion of said insert is a baffle lip mechanically attached to said standoff and said second portion is a baffle body that extends from said baffle lip;

said surface of said platform is a non-gas path surface of said platform; and said axial gap defines an inlet to said internal cavity between an edge defined by said baffle lip and a rail that extends in said radial direction away from said non-gas path surface.

6. The component as recited in claim 5, comprising a cover plate positioned radially outboard of said baffle lip with respect to said radial direction such that said baffle lip is positioned radially between said cover plate and said non-gas path surface.

7. The component as recited in claim 1, wherein said standoff extends between a non-gas path surface of said platform and said first portion of said insert.

8. The component as recited in claim 1, comprising a plurality of standoffs that are cast and/or machined as part of said platform.

9. The component as recited in claim 1, comprising a cover plate positioned radially outboard of said insert.

10. The component as recited in claim 1, wherein said insert is welded or brazed to a vane rib that extends between a first cooling cavity and a second cooling cavity that extend through said airfoil.

11. The component as recited in claim 10, wherein said second portion of said insert extends into at least one of said first cooling cavity and said second cooling cavity.

12. A gas turbine engine, comprising:

a component that includes:

a platform;

an airfoil that extends in a radial direction from said platform, and said airfoil extends in an axial direction between a leading edge and a trailing edge;

an insert having a baffle lip that extends in said axial direction to oppose a surface of said platform and a baffle body that extends from said baffle lip in said radial direction such that said second portion is inside a first cooling cavity of said airfoil; and a standoff that extends away from a surface of said platform to said baffle lip to support said insert and to define a radial gap that extends in said radial direction between said surface of said platform and said baffle lip to establish an internal cooling cavity; and wherein said internal cooling cavity extends along said surface of said platform, across said standoff and between said baffle body and an inner wall of said airfoil.

13. The gas turbine engine as recited in claim 12, wherein said component is a vane.

14. The gas turbine engine as recited in claim 12, wherein said surface is a non-gas path surface of said platform.

15. The gas turbine engine as recited in claim 12, comprising a plurality of standoffs that space apart said baffle lip and said surface in said radial direction.

16. The gas turbine engine as recited in claim 12, comprising a cover plate positioned radially outboard of said surface to create a platform cooling channel.

17. A method of cooling a component of a gas turbine engine, comprising the steps of:

positioning an insert relative to a platform and an airfoil of a component, wherein the airfoil extends in a radial direction from the platform, and the airfoil extends in an axial direction between a leading edge and a trailing edge;

providing a standoff that spaces the insert relative to a surface of the platform to define a radial gap that extends in the radial direction between the surface of the platform and a baffle lip of the insert to define an internal cooling cavity, the internal cooling cavity extending along the surface of the platform, across the standoff and between a baffle body of the insert and an inner wall of the airfoil;

feeding a cooling fluid into the internal cooling cavity between the surface and the baffle lip of the insert;

cooling the surface with the cooling fluid, including communicating the cooling fluid across the standoff and then into the airfoil; and cooling the inner wall of the airfoil with the cooling fluid.

18. The method as recited in claim 17, wherein the step of positioning includes providing a cover plate radially outboard of the insert.

19. The method as recited in claim 17, wherein the surface is a non-gas path surface of the platform.

20. The method as recited in claim 17, comprising feeding the cooling fluid inside the insert.

* * * * *